US009283621B2

(12) United States Patent
Gaster et al.

(10) Patent No.: US 9,283,621 B2
(45) Date of Patent: Mar. 15, 2016

(54) METHOD FOR FORMING A COMPOSITE ARTICLE

(75) Inventors: Robert J. Gaster, Bettendorf, IA (US); Brent A. Augustine, Davenport, IA (US)

(73) Assignee: DEERE & COMPANY, Moline, IL (US)

( * ) Notice: Subject to any disclaimer, the term of this patent is extended or adjusted under 35 U.S.C. 154(b) by 0 days.

(21) Appl. No.: 13/529,497

(22) Filed: Jun. 21, 2012

(65) Prior Publication Data

US 2013/0344344 A1 Dec. 26, 2013

(51) Int. Cl.

| | |
|---|---|
| ***B22F 7/04*** | (2006.01) |
| ***B22F 7/06*** | (2006.01) |
| *B22F 5/00* | (2006.01) |

(52) U.S. Cl.

CPC ..... *B22F 7/062* (2013.01); *B22F 2005/002* (2013.01); *B22F 2998/10* (2013.01); *B22F 2999/00* (2013.01); *Y10T 428/31678* (2015.04)

(58) Field of Classification Search

USPC ..... 419/8, 9, 36, 37; 428/553, 560

See application file for complete search history.

(56) References Cited

U.S. PATENT DOCUMENTS

| | | | | |
|---|---|---|---|---|
| 3,600,201 | A | 8/1971 | Alessi | |
| 4,173,685 | A | 11/1979 | Weatherly | |
| 4,563,329 | A * | 1/1986 | Morishita et al. | 419/9 |
| 4,596,692 | A * | 6/1986 | Morishita et al. | 419/7 |
| 4,596,746 | A * | 6/1986 | Morishita et al. | 428/458 |
| 4,608,225 | A * | 8/1986 | Sakuramoto et al. | 419/5 |
| 4,682,987 | A | 7/1987 | Brady et al. | |
| 4,936,912 | A | 6/1990 | Revankar | |
| 4,937,042 | A * | 6/1990 | Perkins et al. | 419/8 |
| 4,954,058 | A | 9/1990 | Revankar | |
| 5,027,878 | A | 7/1991 | Revankar et al. | |
| 5,190,091 | A | 3/1993 | Revankar | |
| 5,190,092 | A | 3/1993 | Revankar | |
| 5,267,600 | A | 12/1993 | Revankar | |
| 5,288,353 | A | 2/1994 | Revankar | |
| 5,299,620 | A | 4/1994 | Revankar et al. | |
| 5,383,513 | A | 1/1995 | Revankar | |
| 5,403,544 | A | 4/1995 | Adrian et al. | |

(Continued)

FOREIGN PATENT DOCUMENTS

| | | |
|---|---|---|
| AU | 522368 | 6/1982 |
| AU | 617891 | 12/1991 |

(Continued)

OTHER PUBLICATIONS

Hensley Industries, Inc., Laminite Wear Resistant Material, Copyright 2006 Hensley Industries, Inc. (http:/;/www.hensleyind.com/parts_book_protection/pdf/Laminate/Laminite_Wear_Resistant_material.pdf), United States of America.

(Continued)

*Primary Examiner* — George Wyszomierski
*Assistant Examiner* — Ngoclan T Mai

(57) ABSTRACT

A method for forming a composite article includes providing a metallic substrate and a preform adjacent the metallic substrate. The preform includes an unfused metallic powder material with an organic binder dispersed through the powder material. The metallic substrate and the preform are then subjected to a monocyclic heating process. The monocyclic heating process causes removal of the organic binder from the preform, fusing of the metallic powder material and metallurgical bonding of the metallic powder to the metallic substrate.

18 Claims, 1 Drawing Sheet

(56) References Cited

U.S. PATENT DOCUMENTS

| | | | | |
|---|---|---|---|---|
| 5,443,916 | A | 8/1995 | Revankar | |
| 5,593,726 | A | 1/1997 | Nicholls et al. | |
| 5,788,142 | A | 8/1998 | Bigay et al. | |
| 5,879,743 | A | 3/1999 | Revankar | |
| 5,966,585 | A | 10/1999 | Sue | |
| 5,981,081 | A | 11/1999 | Sue | |
| 6,007,922 | A | 12/1999 | Sue et al. | |
| 6,033,788 | A * | 3/2000 | Cawley et al. | 428/548 |
| 6,103,186 | A * | 8/2000 | Sievers et al. | 419/8 |
| 6,309,762 | B1 | 10/2001 | Speckert | |
| 6,572,518 | B1 | 6/2003 | Midorikawa et al. | |
| 6,648,601 | B2 | 11/2003 | Williams | |
| 6,739,411 | B2 | 5/2004 | Burns et al. | |
| 6,948,784 | B2 | 9/2005 | Wodrich et al. | |
| 6,951,258 | B2 | 10/2005 | Burns et al. | |
| 7,116,097 | B2 | 10/2006 | Revankar et al. | |
| 7,163,754 | B2 | 1/2007 | Revankar et al. | |
| 7,282,681 | B2 * | 10/2007 | Kelly | 219/679 |
| 7,345,255 | B2 | 3/2008 | Jiang et al. | |
| 7,473,296 | B2 | 1/2009 | Takayama et al. | |
| 7,513,676 | B2 | 4/2009 | Williams et al. | |
| 7,513,758 | B2 | 4/2009 | Kirkland | |
| 7,637,732 | B2 | 12/2009 | Williams | |
| 7,776,451 | B2 | 8/2010 | Jiang et al. | |
| 2003/0116227 | A1 | 6/2003 | Sim et al. | |
| 2003/0168912 | A1 | 9/2003 | Wodrich et al. | |
| 2005/0064095 | A1 | 3/2005 | Revankar | |
| 2005/0090347 | A1 | 4/2005 | Revankar et al. | |
| 2006/0017323 | A1 | 1/2006 | Wodrich et al. | |
| 2006/0087313 | A1 | 4/2006 | Revankar et al. | |
| 2008/0199343 | A1 | 8/2008 | Rust et al. | |
| 2008/0233296 | A1 | 9/2008 | Revankar | |
| 2009/0249934 | A1 | 10/2009 | Williams et al. | |
| 2010/0101780 | A1 | 4/2010 | Ballew et al. | |
| 2010/0197534 | A1 | 8/2010 | Yuasa et al. | |
| 2010/0215849 | A1 | 8/2010 | Fischer et al. | |

FOREIGN PATENT DOCUMENTS

| | | |
|---|---|---|
| GB | 1248503 | 10/1971 |
| WO | 9808639 | 3/1998 |

OTHER PUBLICATIONS

Domite Brochure, Quality System, ISO9001-1994 Standards Australia 12 pp.

Good Earth Tools (http://www.goodearthtools.com/services/custom-applications/) Wear Protection and Wear Resistant Plate pages description pages, from corporate internet website.

Written Opinion of the International Searching Authority, application No. PCT/US2012/066815, dated Dec. 28, 2014 (5 pages).

International Search Report, application No. PCT/US2012/066815, dated Jan. 3, 2014 (3 pages).

* cited by examiner

METHOD FOR FORMING A COMPOSITE ARTICLE

BACKGROUND

This disclosure relates to a method of forming a composite article, such as a tool, agricultural implement, vehicle component or the like.

Components that are subject to wear often include a wear-resistant coating to extend the life of the component. There are a variety of different techniques by which the coating can be applied. As an example, a wear-resistant coating can be applied using a spray-welding technique, such as flame or plasma spraying. Alternatively, the coating can be applied using a powder technique. The powder technique involves applying an aqueous slurry of a powder material onto the component and multiple heating processes to serve the functions of removing solvent, removing binder agents, consolidating the powder and fusing the consolidated powder to the component. The multiple heating processes are necessary because the conditions that serve each function differ.

SUMMARY

A method for forming a composite article includes providing a metallic substrate and a preform adjacent the metallic substrate. The preform includes an unfused metallic powder material with an organic binder dispersed through the powder material. The metallic substrate and the preform are then subjected to a monocyclic heating process. The monocyclic heating process causes removal of the organic binder from the preform, fusing of the metallic powder material and metallurgical bonding of the metallic powder to the metallic substrate.

In another aspect, a method for forming a composite article includes providing an iron-based substrate that has a first hardness and providing a preform adjacent the iron-based substrate. The preform includes an unfused metallic powder material with an organic binder dispersed through the powder material. The iron-based substrate and the preform are then subjected to a monocyclic heating process that converts the preform into a wear-resistance element. The wear-resistance element has a second, greater hardness and is metallurgically bonded on the iron-based substrate.

Also disclosed is an article that is ready for forming a composite with a metallic substrate. The article includes a preform having an unfused metallic powder material with an organic binder dispersed there through.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION OF THE PREFERRED EMBODIMENT

Figure 1:
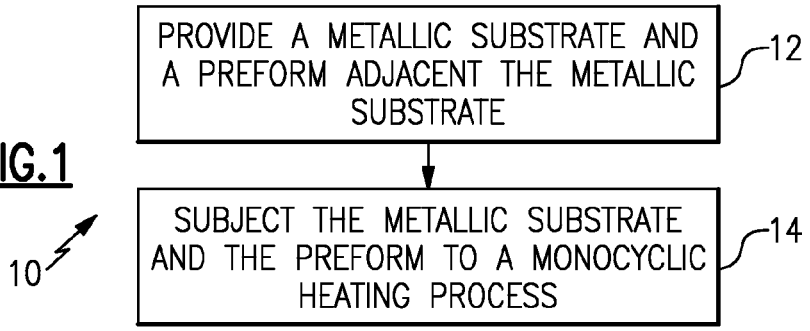
FIG. 1 illustrates a method for forming a composite article.

Disclosed herein is a method 10 for forming a composite article. The method 10 will be described with regard to the flow chart shown in FIG. 1 and various stages of a work piece that is processed according to the method 10 to produce the composite article, which are depicted in FIGS. 2-5. As will be described in further detail, the method 10 can be used to make a composite article, such as a tool, agricultural implement, vehicle component or the like, but is not limited to any particular type of article.

Figure 2:
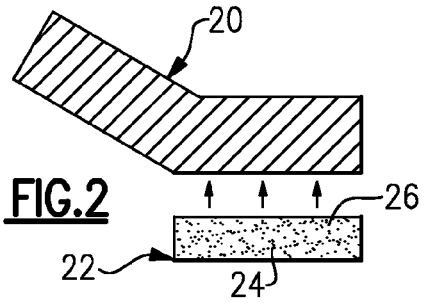
FIG. 2 illustrates a metallic substrate and a preform.
Figure 3:
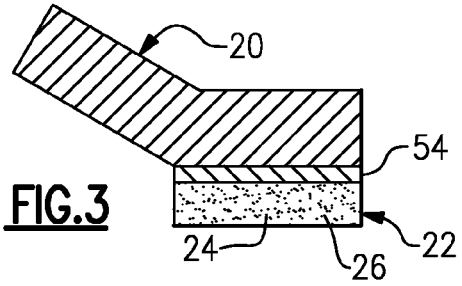
FIG. 3 illustrates a modified example in which an adhesive holds a preform on a metallic substrate.

The method 10 includes step 12 of providing a metallic substrate 20 and a preform 22, as shown in FIG. 2 or FIG. 3. The preform 22 includes an unfused metallic powder material 24 and an organic binder 26 that is dispersed through the unfused metallic powder material 24. In a further example, the organic binder is solid or semi-solid and is or includes polyvinyl alcohol, a hydrocarbon wax, or other organic polymeric material that is able to hold the metallic powder material 24 together such that the preform 22 is self-supporting. The organic binder may also facilitate holding the preform 22 on the metallic substrate.

The preform 22 is arranged adjacent the metallic substrate 20 (see FIG. 4), to form what is considered to be an intermediate article or work piece. For example, the preform 22 is in contact with the metallic substrate 20.

As shown in a modified example in FIG. 3, the preform 22 can alternatively be bonded to the metallic substrate 20 using an adhesive 54. For example, the adhesive 54 is a layer of the organic binder 26 that is substantially or completely free of any of the metallic powder material 24. In other alternatives, the adhesive 54 is a polymeric or organic material having a different composition than the organic binder 26. The adhesive 54 holds the preform 22 on the metallic substrate 20 prior to a monocyclic heating process 28 described below. For example, the adhesive 54 facilitates holding the preform 22 on sloped, vertical or other surfaces of the metallic substrate 20 where gravitational forces are insufficient to properly position the preform 22 on the metallic substrate 20. Thus, the method 10 can also include a step of applying the adhesive 54 and securing the preform 22 to the metallic substrate 20 using the adhesive 54.

Figure 4:
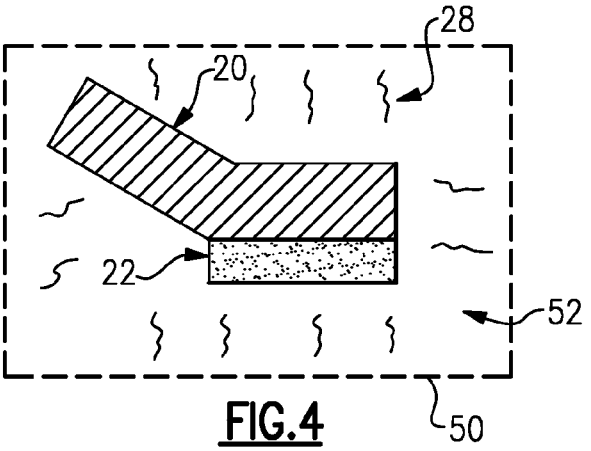
FIG. 4 illustrates a metallic substrate and an adjacent preform in a monocyclic heating process.

The method 10 further includes a heating step 14. As depicted in FIG. 4, the metallic substrate 20 and adjacent preform 22 are subjected to a monocyclic heating process 28 that causes the removal of the organic binder 26 from the preform 22, fusing of the metallic powder material 24 and metallurgical bonding of the metallic powder 24 to the metallic substrate 20. If the adhesive 54 is used, the monocyclic heating process 28 also causes removal of the adhesive 54.

Figure 5:
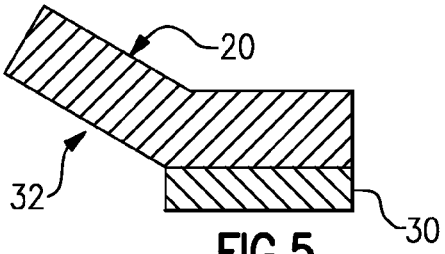
FIG. 5 illustrates a final composite article.

As shown in FIG. 5, after the monocyclic heating process 28, the fusing and metallurgical bonding of the metallic powder material results in the formation of a relatively dense element 30 that is strongly bonded to the metallic substrate 20 to form the final composite article 32.

In a further example, the composition of the metallic powder material 24 of the preform 22 is selected such that the resulting dense element 30 serves as a wear-resistance element. In this regard, the metallic substrate 20 defines a first hardness and the dense element 30 defines a second, greater hardness such that the dense element 30 effectively provides a reduced wear rate and protects the underlying metallic substrate 20 from abrasion and the like. The thickness of the preform 22 corresponds to the final thickness of the dense element 30. Relatively thick dense elements can be produced using the disclosed method, without the use of multiple coating passes and waste of materials in comparison to aqueous slurry techniques.

As an example, the metallic substrate 20 is an iron-based material, such as steel, and the metallic powder material of the preform 22 has a composition that is substantially harder and more wear-resistant than the metallic substrate 20. The composition of the metallic powder material, and thus the dense element 30, has a Knoop hardness value in the range of 800 to 1400. In a further example, the metallic powder material 24 is a nickel-based alloy, cobalt-based alloy or iron-based alloy. Additionally, the selected alloy can further include 0.1-20% by weight of boron, carbon, chromium, iron (in nickel and cobalt based alloys) manganese, nickel (in iron and cobalt based alloys), silicon, tungsten or combinations thereof. In a further example, the nickel, cobalt or iron is present in 60% by weight or more in the above compositions. In a further example, the composition of the metallic powder material is an example composition set forth in the Table below.

TABLE

Example Compositions 1-4, by weight percentage.

| | Example | | | |
|---|---|---|---|---|
| Element | 1 | 2 | 3 | 4 |
| Boron | 3 | 3.29 | 3.08 | 2 |
| Carbon | 0.7 | 2.18 | 1.98 | 0.6 |
| Chromium | 14.3 | 14.44 | 14.12 | 12.35 |
| Cobalt | — | — | — | Bal. |
| Iron | 4 | Bal. | Bal. | 1.3 |
| Manganese | — | 0.31 | 0.5 | — |
| Nickel | Bal. | 5.72 | 5.64 | 23.5 |
| Silicon | 4.25 | 3.09 | 2.74 | 1.9 |
| Tungsten | — | — | — | 7.6 |

Figure 6:
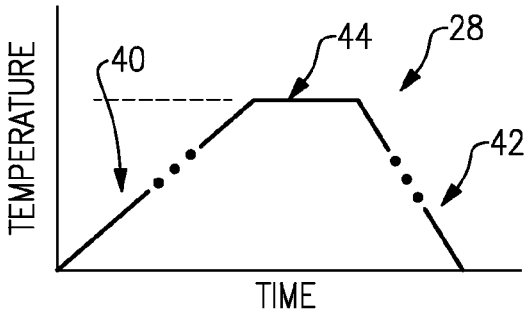
FIG. 6 illustrates a plot of temperature versus time for a monocyclic heating process.

As used in this disclosure, the term "monocyclic heating process" refers to a heating process that includes only one temperature ramp-up and only one temperature ramp-down. FIG. 6 shows a plot of the monocyclic heating process 28 to further illustrate. The plot shows temperature versus time. The monocyclic heating process 28 includes a ramp-up portion 40, a ramp-down portion 42 and a hold or soak portion 44, which in this example is at a maximum temperature between the ramp-up portion 40 and the ramp-down portion 42. In the ramp-up portion 40, the temperature does not decrease. That is, the temperature in the ramp-up portion 40 continually increases or has periods of constant temperature. Similarly, in the ramp-down portion 42, the temperature does not increase and continually decreases or has periods of constant temperature. Thus, there are no temperature decreases in the ramp-up portion 40 and no temperature increases in the ramp-down portion 42. In that regard, there is only one cycle of ramping-up and ramping-down the temperature in the monocyclic heating process 28.

The temperatures and heating rates of the ramp-up portion 40, the ramp-down portion 42 and the hold or soak portion 44 depend on the materials selected for the unfused metallic powder 24 and metallic substrate 20. In examples based on using an iron-based material as the metallic substrate 20 and nickel-based, cobalt-based or iron-based alloys for the metallic powder 24, the ramp-up portion 40 may have a predetermined heating rate and may optionally include one or more hold portions prior to the soak portion 44, to facilitate binder removal, for example. The soak portion 44 may be at a temperature of approximately 1100° C. for a predetermined amount of time, to promote solid state fusion of the metallic powder 24 and metallurgical bonding of the metallic powder 24 and the metallic substrate 20. The ramp-down portion 42 may have a controlled, prescribed cooling rate or natural cooling rate obtainable in ambient air.

The monocyclic heating process 28 thus enhances process efficiency and lowers cost in comparison to multicycle heating processes that involve multiple temperature ramp-ups and ramp-downs because less energy, such as electrical energy, is required. Moreover, the monocyclic heating process 28 also involves less labor in handling work pieces, which also further reduces costs in comparison with a multicycle heating process that require additional handling.

In a further example, the monocyclic heating process 28 includes heating the metallic substrate 20 and the preform 22 in a furnace or chamber 50 (FIG. 4) and in an environment 52 that substantially includes argon, helium, hydrogen or combinations thereof. That is, the environment 52 surrounding the metallic substrate 20 and the preform 22 includes at least 50% by volume or greater of argon, helium, hydrogen or the combined amount of argon, helium and hydrogen. Additionally, the environment may be low in nitrogen and oxygen, to reduce undesirable reactions between the materials of the metallic substrate 20 and the metallic powder 24. Argon and hydrogen are considered to be inert gases with regard to the metallic substrate 20, metallic powder material 24 and solid organic binder 26. Thus, the metallic substrate 20, the metallic powder material 24 and the organic binder 26 do not substantially react with the environment 52 or each other. Hydrogen, if used, provides a reducing environment.

In a further example, the pressure of the environment 52 within the furnace or chamber 50 is controlled to establish a substantially atmospheric pressure. As an example, the pressure within the furnace or chamber 50 is established at atmospheric pressure +/−100%. In some examples, the pressure of the environment 52 may thus be slightly positive to ensure that outside gases do not tend to leak into the furnace or chamber 50.

The method of forming the composite article can further include forming the preform 22, although the preform 22 could be independently provided. As an example, the forming of the preform 22 includes providing the unfused metallic powder material 24 and the organic binder 26 in a mixture and consolidating the mixture to form the preform 22.

The technique used for consolidating can vary depending upon the desired shape of the preform 22. In one example, the technique includes consolidating the mixture under pressure, and optionally heat, to form the desired shape of the preform 22. In an alternate example, the mixture is extruded. It is to be understood, however, that other techniques may alternatively be used to form the preform 22 into a desirable shape. In that regard, it is to be understood that the preform 22 can be shaped to correspond to the shape of the metallic substrate 20 in the area to which the preform 22 is to be bonded. That is, the preform 22 generally conforms to the shape of the surface of the metallic substrate 20 such that there is relatively close or intimate contact between the preform 22 and the metallic substrate 20 in the monocyclic heating process 28.

The average size of the particles of the metallic powder material 24 is selected for enhanced fusing and metallurgical bonding in the monocyclic heating process 29. In comparison, in slurry-based techniques, relatively small particle sizes are used to obtain desired slurry properties. However, since the preform 22 of the present disclosure is not formed using a slurry-based technique and can be formed separate from the presence of the metallic substrate 20, the average particle size can be relatively larger such that quality fusing and bonding can be achieved in the monocyclic heating process 28. In one example, the unfused metallic powder material 24 has an average particle size of greater than 45 micrometers.

Figure 7:
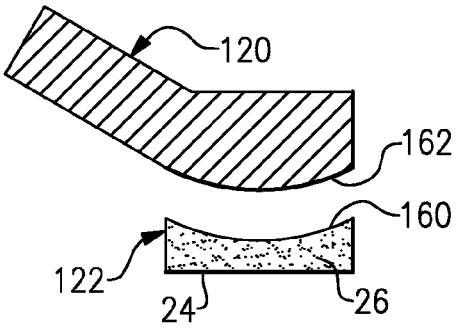
FIG. 7 illustrates another example metallic substrate and preform
Figure 8:
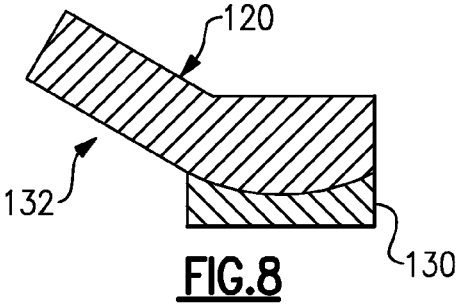
FIG. 8 illustrates another example final composite article.

FIG. 7 illustrates another example preform 122. In this disclosure, like reference numerals designate like elements where appropriate and reference numerals with the addition of one-hundred designate modified elements that are understood to incorporate the same features and benefits of the corresponding elements. In this example, the preform 122 is similar to the preform 22 but includes at least one curved surface 160. A metallic substrate 120 includes a corresponding curved surface 162 onto which the preform 122 will be bonded in the method 10 as described above. As shown in FIG. 8, the preform 122 has been converted according to the method described herein to produce the dense element 130 in the final composite article 132. Thus, the preform 122 can be formed with contours, curves or other shapes that generally conform to the surface areas of the metallic substrate 120 where there is a need to provide wear resistance. The preform 122 thus fits in close conformance with such areas on the metallic substrate 120 to form a good metallurgical bond.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A method for forming a composite article, the method comprising:

providing an iron-based substrate having a first hardness;

arranging adjacent a preform in contact with a surface of the iron-based substrate, the preform including an unfused metallic powder material with an organic binder dispersed there through;

subjecting the iron-based substrate and the preform to a monocyclic heating process, the monocyclic heating process converting the preform into a wear-resistance element having a second, greater hardness and that is metallurgically bonded on the iron-based substrate; and wherein the metallic powder material is a nickel-based alloy.

2. The method as recited in claim 1, wherein the preform is self-supporting.

3. The method as recited in claim 1, wherein the preform includes at least one curved surface.

4. The method as recited in claim 1, wherein the monocyclic heating process includes heating in an environment that is at substantially atmospheric pressure.

5. The method as recited in claim 1, wherein the monocyclic heating process converts the preform into a wear-resistant element that is harder than the metallic substrate.

6. The method as recited in claim 1, including forming the preform by mixing together the unfused metallic powder material and the organic binder, and then applying pressure to the mixture to mold the mixture into the preform.

7. The method as recited in claim 1, including forming the preform by extrusion.

8. The method as recited in claim 1, wherein the metallic powder material has a composition including greater than 60% by weight of nickel, and 0.1-20% by weight of minor alloying elements selected from a group consisting of boron, carbon, chromium, iron, manganese, nickel, silicon, tungsten and combinations thereof.

9. The method as recited in claim 1 wherein the monocyclic heating process includes heating in an environment substantially including a gas selected from the group consisting of argon, helium, hydrogen and combinations thereof.

10. The method as recited in claim 1, wherein the unfused metallic powder material has an average particle size of greater than 45 micrometers.

11. The method as recited in claim 1, wherein the preform is more wear-resistant and has a greater hardness than the iron-based metallic substrate.

12. A method for forming a composite article, the method comprising:

providing an iron-based substrate having a first hardness;

arranging adjacent a preform in contact with a surface of the iron-based substrate, the preform including an unfused metallic powder material with an organic binder dispersed there through;

subjecting the iron-based substrate and the preform to a monocyclic heating process, the monocyclic heating process converting the preform into a wear-resistance element having a second, greater hardness and that is metallurgically bonded on the iron-based substrate; and wherein the metallic powder material is a cobalt-based alloy.

13. The method as recited in claim 12, including forming the preform using a process selected from the group consisting of molding and extrusion.

14. The article as recited in claim 12, wherein the preform is self-supporting.

15. The article as recited in claim 12, wherein the preform includes at least one curved surface.

16. The article as recited in claim 12, wherein the metallic powder material has a composition including greater than 60% by weight of cobalt.

17. The article as recited in claim 16, wherein the composition includes 0.1-20% by weight of minor alloying elements selected from the group consisting of boron, carbon, chromium, iron, manganese, nickel, silicon, tungsten and combinations thereof.

18. The article as recited in claim 12, wherein the unfused metallic powder material has an average particle size of greater than 45 micrometers.

* * * * *